United States Patent [19]

Herd et al.

[11] 3,971,576

[45] July 27, 1976

[54] UNDERWATER WELL COMPLETION METHOD AND APPARATUS

[75] Inventors: David P. Herd, Houston, Tex.; John H. Fowler, Pittsburgh, Pa.

[73] Assignee: McEvoy Oilfield Equipment Co., Houston, Tex.

[22] Filed: Aug. 13, 1973

[21] Appl. No.: 387,667

Related U.S. Application Data

[60] Division of Ser. No. 103,839, Jan. 4, 1971, Pat. No. 3,800,869, which is a continuation of Ser. No. 792,912, Jan. 22, 1969, abandoned, which is a continuation-in-part of Ser. No. 728,081, May 9, 1968, Pat. No. 3,442,536, which is a continuation of Ser. No. 572,511, Aug. 15, 1966, abandoned.

[52] U.S. Cl. ..... 285/87; 166/.5; 175/7; 285/351; 285/376; 285/391

[51] Int. Cl.[2] ..... F16L 37/24

[58] Field of Search ..... 285/87, 88, 92, 391, 285/376, 401, 351; 403/320, 319; 61/53.5; 166/.5; 175/7

[56] References Cited

UNITED STATES PATENTS

| | | | |
|---|---|---|---|
| 222,713 | 12/1879 | Lawson | 285/376 X |
| 290,663 | 12/1883 | Blue | 285/391 X |
| 725,337 | 4/1903 | Haeseler | 403/320 |
| 1,080,675 | 12/1913 | Berg | 285/87 |
| 1,372,238 | 3/1921 | Kreiter | 285/391 X |
| 1,469,009 | 9/1923 | Overstreet | 285/391 X |
| 2,539,456 | 1/1951 | Meier | 61/53.5 X |
| 2,695,797 | 11/1954 | McCarthy | 285/391 X |
| 2,924,434 | 2/1960 | Potter et al. | 285/376 X |
| 3,014,740 | 12/1961 | Bogosian et al. | 285/376 X |
| 3,116,942 | 1/1964 | Morello | 285/401 X |
| 3,275,354 | 9/1966 | Sutliff et al. | 285/391 X |
| 3,421,580 | 1/1969 | Fowler et al. | 166/.5 |
| 3,442,536 | 5/1969 | Fowler | 285/391 X |

FOREIGN PATENTS OR APPLICATIONS

| | | | |
|---|---|---|---|
| 373,608 | 1/1964 | Switzerland | 285/376 |

*Primary Examiner*—Thomas F. Callaghan
*Attorney, Agent, or Firm*—David M. Ostfeld; David Alan Rose; Ned L. Conley

[57] ABSTRACT

Extended casing method and apparatus for completing an underwater well whereby complete and continuous pressure control is maintained at the surface drilling platform. A conductor casing is installed in the floor of a body of water with a casing head and riser attached near the floor. Other casing is installed and supported at the water floor by hanger heads and having other risers extending upwardly therefrom. Pressure control equipment is installed at the upper end of one of the risers. An innermost casing having a tubing hanger-head attached is lowered through the pressure control equipment and installed. An orientation sleeve is aligned with the tubing hanger-head to properly orient the tubing hanger. The tubing hanger and tubing is then passed through the pressure control equipment and the innermost riser, to which the pressure control equipment is attached, and is lowered to engage the orientation sleeve for proper alignment with the innermost hanger-head and remotely latched thereto. All seals are then pressure tested. The tubing is plugged, the riser and control equipment removed and a Christmas tree adapter connected to the tubing hanger head. A assembly is then attached to the adapter in fluidtight flow communication with the tubing string.

9 Claims, 14 Drawing Figures

UNDERWATER WELL COMPLETION METHOD AND APPARATUS

This is a division of application Ser. No. 103,839 filed Jan. 4, 1971 now U.S. Pat. No. 3,800,869, which is a continuation of application Ser. No. 792,912 filed Jan. 22, 1969, now abandoned, which is a continuation-in-part of application Ser. No. 728,081 filed May 9, 1968 and now U.S. Pat. No. 3,442,536 issued May 6, 1969, which is a continuation of Ser. No. 572,511 filed Aug. 15, 1966, now abandoned.

BACKGROUND OF THE INVENTION

1. Field of the Invention

This invention concerns underwater drilling of oil and gas wells. Specifically, it pertains to methods and apparatus used in underwater extended casing operations.

2. Description of the Prior Art

Increased activity in offshore drilling has resulted in a continuous search for better methods and apparatus in this area. To cope with the unique problems associated with underwater drilling various extended casing methods have been developed. Basically, extended casing methods have a well conductor anchored to the sea floor which provides support for a special underwater wellhead. The wellhead, in turn, supports a multiple number of casing strings and their respective casing hangers. The drilling platform is thus relieved of much of the structural support responsibilities of other methods. After drilling is completed, the well may be permanently abandoned, temporarily abandoned or immediately completed. For any of these options, the completion equipment may be installed at the sea floor, leaving the drilling platform free for relocation and freeing the underwater wellhead from the hazards of ocean going traffic and structural support problems. One such extended casing method is fully described in copending U.S. pat. application Ser. No. 572,599.

In the extended casing methods of the prior art, one or more intermediate casing strings, in addition to the conductor and the innermost production casing string, are usually supported in the wellhead. Casing extensions or risers are attached to these strings as they are lowered into place and landed. The extensions are connected at the surface to a blowout preventer for pressure control and also serve as a return for cement circulation. In the past it has been necessary to remove all casing extensions, except possibly the outer conductor riser, for installation of the tubing head with the collet connector flange for making connection with the underwater tree, the tubing hanger and tubing strings. This requires removal of the surface blowout prevention equipment. In some cases, for safety precautions, a bridge plug is set in the production casing prior to removal of the production casing riser. The tubing head is attached to the production casing hanger head and a high pressure riser extended back to the surface for reattachment of the preventer equipment. The bridge plug is then drilled out or otherwise and the well is then ready to receive tubing. These operations require additional equipment time, and consequently expenses.

Some methods have utilized underwater blowout preventers installed near the underwater wellhead. However, such preventers are very expensive and more complex to operate than the conventional above water type.

SUMMARY OF THE INVENTION

The present invention concerns a method of completing an underwater well comprising the steps of: locating drilling means at an underwater well site; installing conductor casing in the floor of a body of water with a casing head and riser attached thereto at a point near the floor, the conductor riser extending upwardly to the drilling means; drilling holes for, suspending within the conductor casing and cementing in place other casing, each of the other casing being suspended near the floor by hanger means above which other risers, extending upwardly to the drilling means, are connected; attching blowout pressure control equipment to the top of at least one of the other risers prior to removal of any of the other riser; removing through the pressure control equipment any of the other risers which are surrounded by the riser to which the pressure control equipment is attached; running a tubing hanger and at least one tubing string through the control equipment and the riser to which it is attachd into the innermost casing; suspending and latching the tubing hanger and tubing string in the innermost hanger means; and removing the pressure control equipment and the remainder of the other risers.

This method provides complete and continuous pressure control throughout completion by providing apparatus whereby the tubing hanger and tubing string may be lowered through blowout preventers and a riser to their support positions. After latching the tubing hanger and tubing string in place the tubing is plugged and the riser and pressure control equipment are removed for installation of the Christmas tree assembly.

BRIEF DESCRIPTION OF THE DRAWINGS

Other objects and advantages of the invention will become apparent from the description which follows when taken in conjunction with the drawing in which.

DESCRIPTION OF THE PREFERRED EMBODIMENTS

The present invention is an extended casing completion system for use when drilling from a bottom supported rig with blowout prevention control equipment at the surface. Several options on the method of completion are available, including:

1. Easy permanent abandonment,
2. Temporary abandonment,
3. Completion by extension of casing, risers to a platform,
4. Casing-tubing sub-surface completion with optional diver support or fully remote operation, and
5. Tubingless sub-surface completion with optional diver support or fully remote operation.

The apparatus of the present invention permits installation of one or more tubing strings through blowout prevention control equipment and extended risers, eliminating the necessity of removing the risers and blowout preventers when preparing the well for completion. Because all operations are conducted through the risers and blowout preventers, well pressure control is continuous and remote guidance systems are not necessary when temporarily abandoning the well or preparing it for completion. A guide base is not installed until a decision is made to complete the well. This allows a selection at that time of either fully remote Christmas tree installation or diver support Christmas tree installation.

Figure 11:
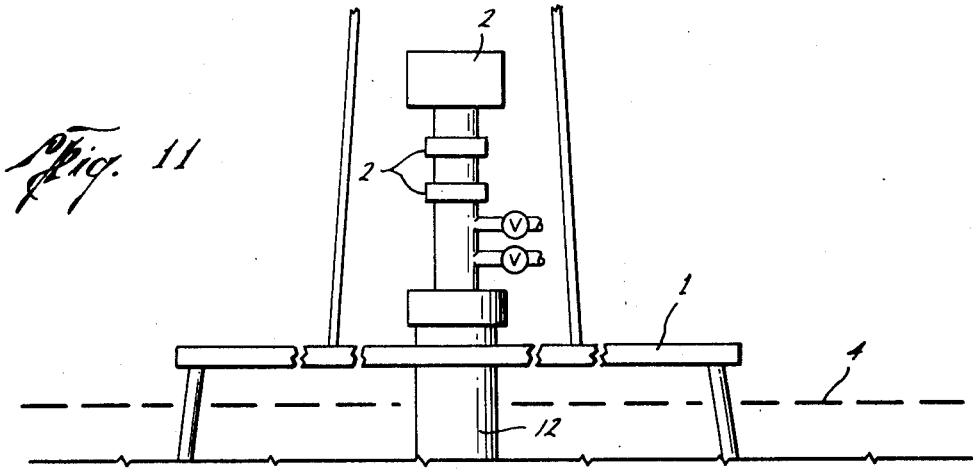
FIGS. 11 and 12 illustrate an exemplary environment in which the present invention may operate.
Figure 12:
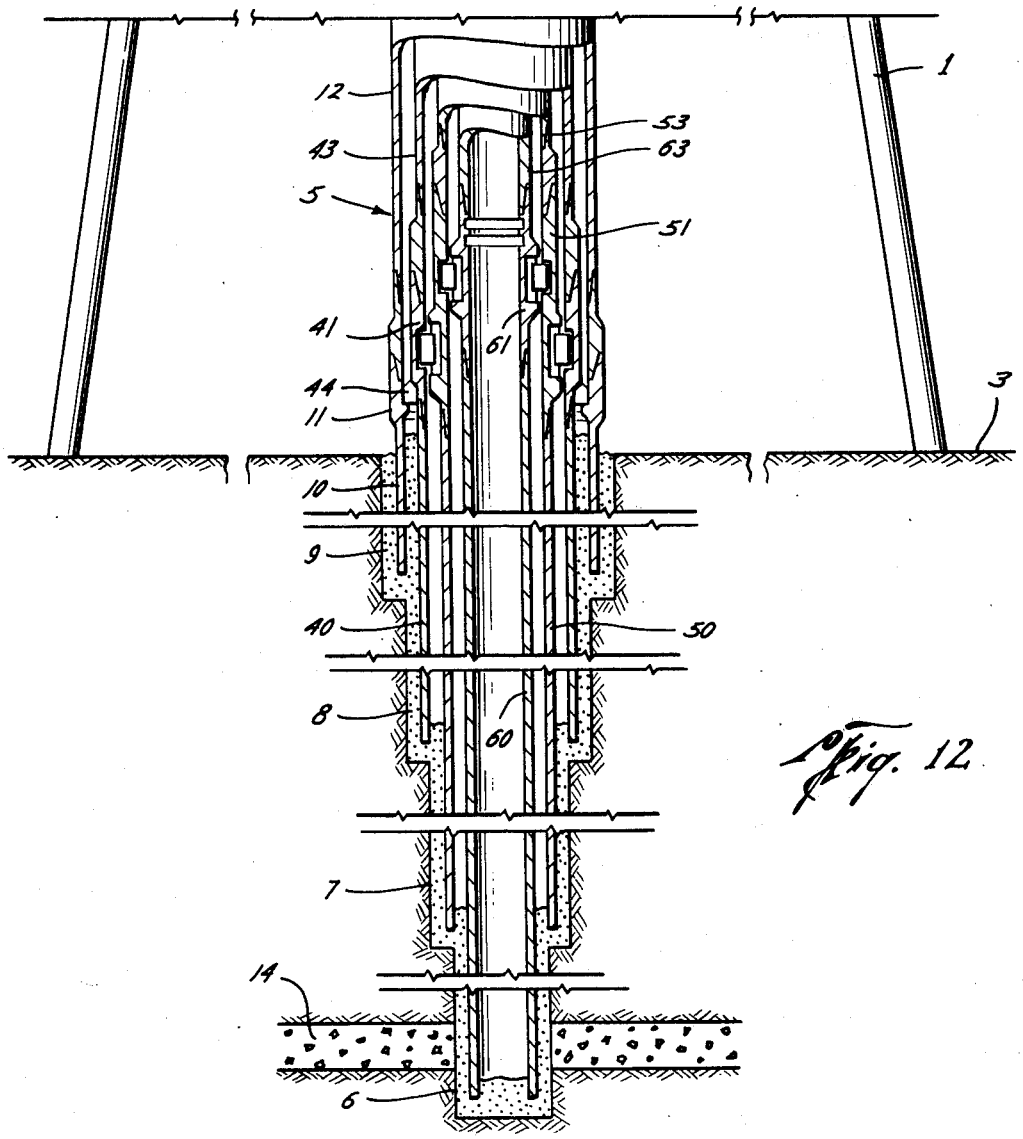

Referring now to FIGS. 11 and 12, there is illustrated a bottom supported well drilling and completion apparatus which is entirely conventional except for the tubing hanger-head which is shown in more detail in the other FIGS. FIG. 11 shows the upper portion of a bottom supported rig 1 with blowout prevention control equipment 2 above the water surface 4 and surmounting the upper end of risers 12, 43, 53 and 63 extending from the rig 1 to the well head 5 at the mudline 3.

FIG. 12, in larger scale, shows a downward extension of risers 12, 43, 53, 63 from the rig 1 to the mudline 3 beneath the water surface 4, and also shows the well head 5 supporting progressively smaller concentric casing strings 10, 40, 50 and 60 in the well bore. Each string of casing is cemented in the well bore from the lower ends of the casing strings to a level thereabove as indicated at 6, 7, 8, and 9. Production casing 60 extends from the rig 1 through the ocean floor 3 and water 4 to the production zone 14.

Referring first to FIGS. 1 through 6, a step by step description of casing-tubing sub-surface completion, according to a preferred embodiment of the invention, will be given. The system described will be a 30 × 16 × 10¾ × 7 inches casing program with two 2⅜ inches tubing strings. However, it is to be understood that the size and number of casing and tubing may vary without departing from the principles of the invention.

First, a 30 inches conductor casing 10, casing head 11, and conductor riser 12 are lowered from the drilling platform 1 and driven or jetted into the sea floor 3 until casing head 11 rests near the floor. If bottom conditions require it, a hole may be drilled for conductor casing 10. Casing head 11 is provided with an upwardly facing stop shoulder 13 for locating the surface casing.

Figure 1:
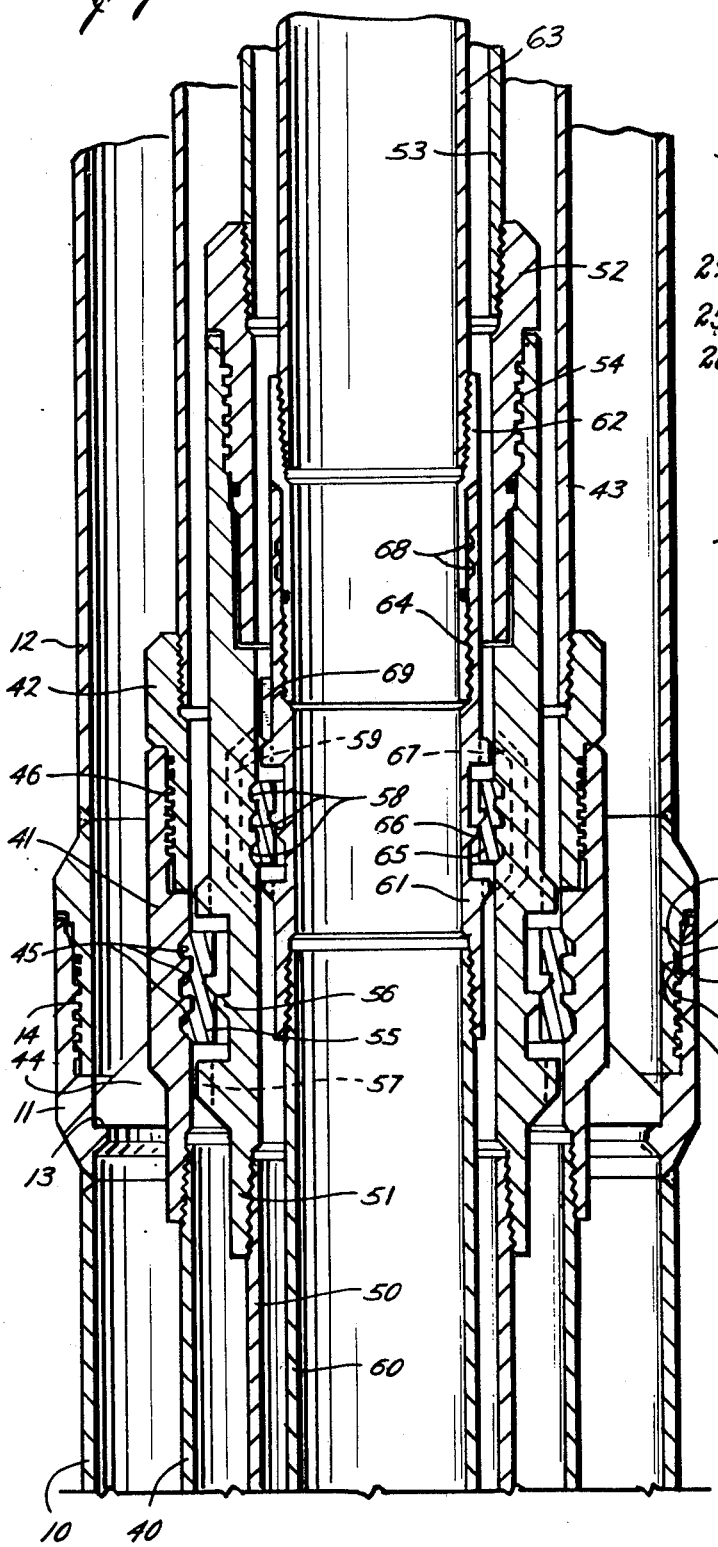
FIGS. 1 through 6 are step by step sectional elevation views of an underwater well showing a method and apparatus for completing a dual tubing string well according to a preferred embodiment of the invention.
Figure 1A:
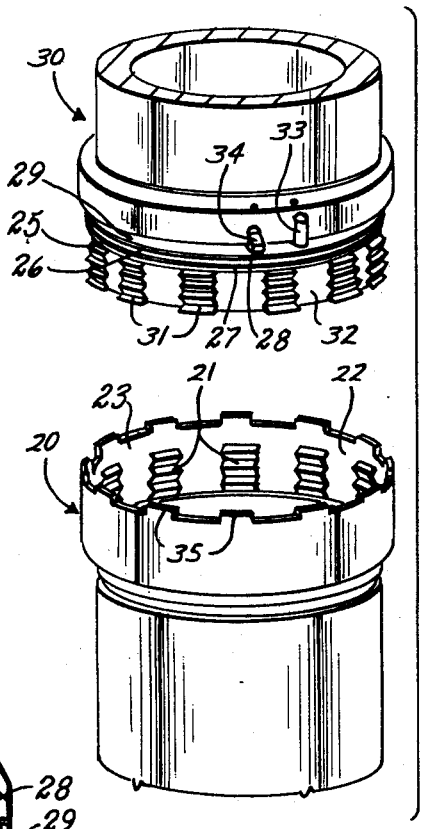

Riser 12 is connected to casing head 11 by an easily disengageable connection 14. One type of easily disengageable joint is shown in FIG. 1A. This type of joint, which we refer to as a breech block joint, reduces drilling costs by eliminating on-site welding, permitting easy recovery of casing risers and reducing rig time during making, running and recovering casing risers. The joint comprises a female member 20 and a male member 30. Segmented threads 21 of a square non-lead profile spaced 30° apart are milled in the female member for engagement with corresponding segmented threads 31 on the male member. Smooth milled out areas 22, 32 are provided between the thread segments 21, 31. For descriptive purposes the thread segments 21, 31 are referred to as lands and milled out areas 22, 32 as grooves. Female member 20 includes an internal sealing surface 23 for sealing engagement with O-ring seals 25, 26 received by grooves 27, 28 in the external surface 29 of male member 30. Engagement is accomplished by inserting the lands of the male member 30 in the grooves of the female member 20, then rotating the male member 30° in either direction until the lands of each member are in full engagement. A positional stop 33 on the male member cooperates with lugs 35 around the female member to limit rotation to 30°. A pivotable anti-rotation latch 34 may be provided to engage the opposite side of lugs 35 preventing disengagement of the joint.

After the 30 inches conductor casing is set, a hole is drilled for 16 inches surface casing 40, which is lowered into place with surface casing head 41, back-off joint 42 and surface casing riser 43 attached thereto. Backoff joint 42 and head 41 may be connected by a breech block joint 46 similar to that shown in FIG. 1A. Landing lugs 44 are provided on surface casing head 41 cooperating with stop shoulder 13 to locate surface casing 40. The surface casing 40 is then cemented in place. The remaining strings will be supported by the cement around surface casing 40. Casing head 41 is provided with internal annular recesses to receive hanging latches for the next string.

Next a hole is drilled for the 10¾ inches intermediate casing string 50 which is lowered into the hole attached to hanger-head 51, back-off joint 52, and riser 53 and cemented in place. Hanger-head 51 and back-off joint 52 are connected with another breech block connection 54. Hanger-head 51 is provided with spring biased latches 55 which support the casing string 50 within the well. As the latches 55 engage recesses 45, a locking rib 56 on the hanger-head body locks them into positive engagement. Hanger-head 51 may be provided with internal circulation ducts 57 or the latches 55 may be fluted for cement circulation. Internal latch recess 58 and circulation ducts 59 may be provided for ducting around the next hanger-head. Blowout prevention control equipment is attached to the top of riser 53 at the the drilling platform 1.

Next the hole for production casing string 60 is drilled and the production string is landed and cemented in place attached to hanger-head 61, back-off joint 62 and riser 63. Production string hanger-head 61 is similar to hanger-head 51 having spring latches 65 a locking rib 66 and if necessary flow ducts 67. However, it has no internal latch recesses and it is connected to back-off joint 62 by a left hand thread connection 64 rather than a breech block joint. Immediately above the connection 64 two internal tubing hanger hold down recesses 68 are cut. An external key 69 provides orientation for a subsequently installed tubing hanger. Therefore, the production string 60 must be properly oriented while running in place.

The aforementioned drilling is done through the blowout prevention equipment at the drilling platform. At this stage of the drilling, the wellhead equipment would be as shown in FIG. 1. At this time the production string riser 63 is removed by rotating the riser 63 and back-off joint 62 to the right.

Figure 2:
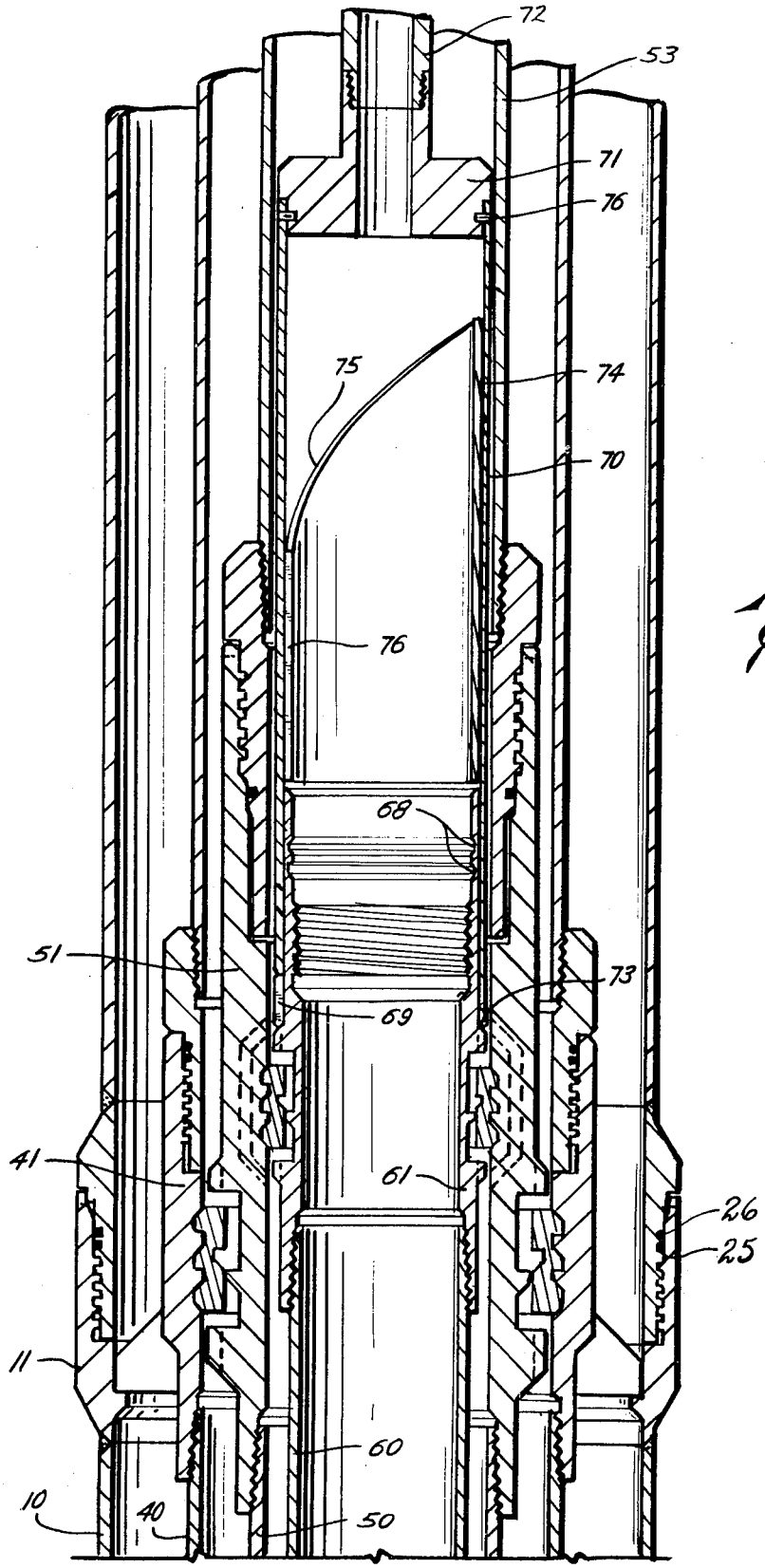

Referring specifically now to FIG. 2, an orientation sleeve 70 connected by a "J" slot arrangemet 76 to running tool 71 and running string 72 is run through 10¾inches riser 53. A longitudinal slot at the base of sleeve 70 engages hanger-head key 69 and the sleeve comes to rest against hanger-head shoulder 73. An orientation bushing 74 is affixed to the interior of sleeve 70 for automatic guidance of a tubing hanger which is to be installed. It has a dual 180° ramp 75 and a vertical slot 76 communicating with the ramp at its lowermost intersection. Tool 71 is then disconnected from orientation sleeve 70 and removed.

Figure 3:
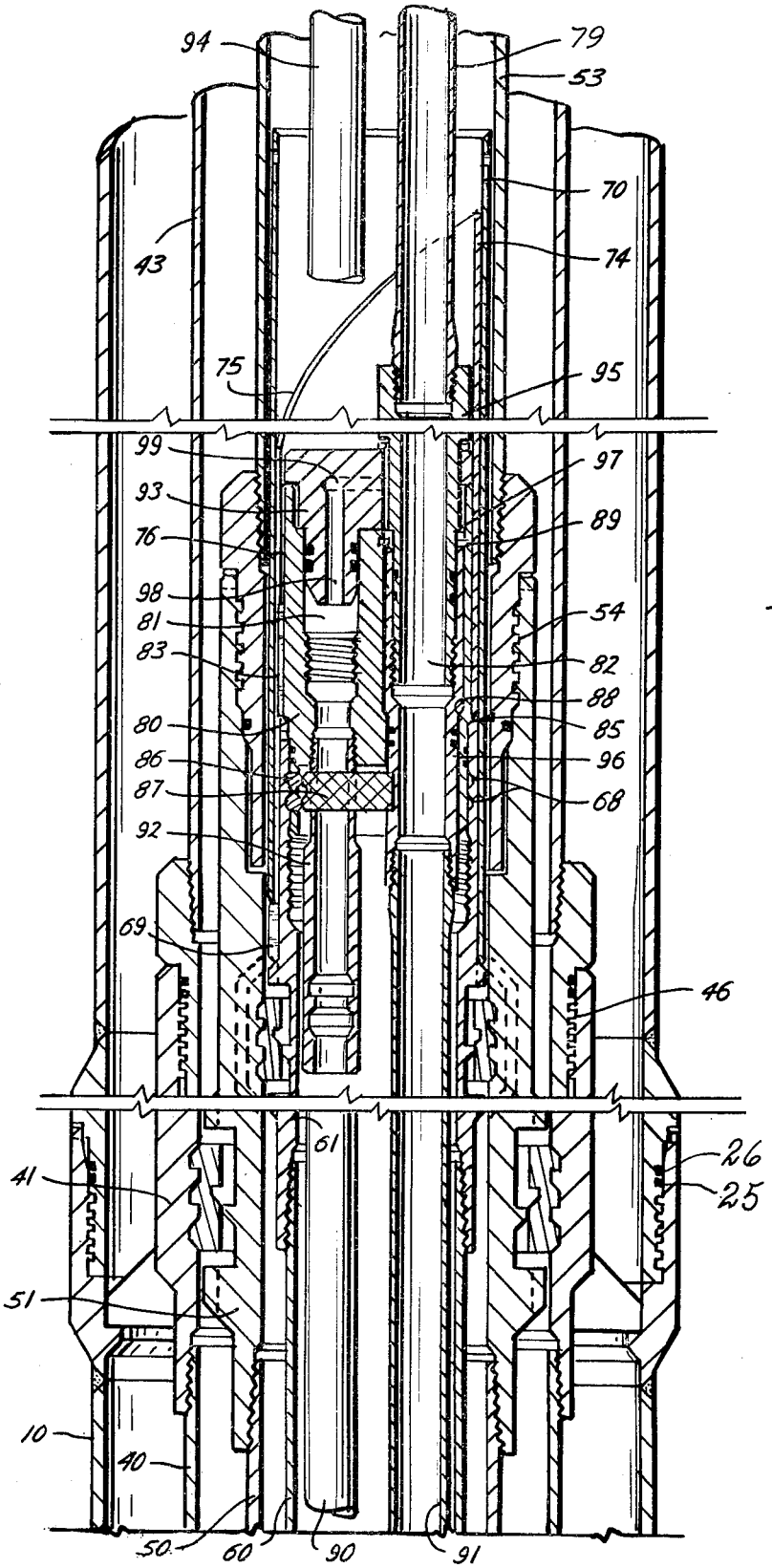

Referring now to FIG. 3, a tubing hanger 80, tubing 90, 91 and annulus access nipple 92 are installed along with test tool 93. Tubing hanger 80 is provided with three vertical bores 81, 82 (one not shown) communicating with annulus access nipple 92 and tubing strings 90, 91. Long tubing handling string 94 is connected to hanger 80 by a handling nipple (not shown) similar to handling nipple 95 connected to short string handling string 79. Both nipples pass through test tool 93. However, nipple 95 is screwed into a landing nipple 96 whereas the long string handling nipple is screwed directly in hanger 80. Both tubing strings 90, 91 are lowered together. However, short string 91 is displaced upwardly a slight amount from the position shown in FIG. 3.

Hanger 80 is provided with a longitudinal key 83 which rides on orientation bushing ramp 75 unitil it engages orientation slot 76 orienting the tubing hanger 80. The tubing hanger comes to rest on the upper shoulder 85 of hanger-head 61. A hold down latch 86 and locking sleeve 87 are mounted in a skirt portion of hanger 80 near its base. In the running position the latch 86 is retracted and locking sleeve 87 is held up against the body of hanger 80 by engagement with landing nipple 96. When the hanger 80 is landed, short tubing string 91 and landing nipple 96 are allowed to move downwardly to the position shown in FIG. 3, where it is supported by shoulder 88, causing locking sleeve 87 to force hold down latch 86 into engagement with hanger-head hold down recesses 68. Up to this point handling nipple 95 and landing nipple 96 are fully made up so that the upper edge of landing nipple 96 is abutting downwardly facing shoulder 97 on handling nipple 95. By rotating handling nipple 95 to the right these shoulders are separated allowing a snap ring 89 in hanger 80 to spring out engaging the upper edge of landing nipple 96 and holding the short tubing string 91 down. At this point all wellhead components appear as shown in FIG. 3.

Next the tubing hanger seals would be tested by pressurizing through short tubing string 91. Pressure would then be applied below the tubing hanger 80 and through annulus access nipple 92 and tubing 90. Testing tool 93 is provided with a vertical port 98 and a horizontal port 99 which communicates with long tubing string 90 through a port in the handling nipple (not shown) attached to handling string 94. Should any of the seals around hanger 80 and landing nipple 96 leak, it will be detected in riser 53.

Next, the downhole tubing packer is set, usually by hydraulic means, a back pressure valve is installed in long string 90 and the packer pressure tested. Pressure is applied through short string 91. If the packer leaks the test fluid passes through annular access nipple 92 and through test tool ports 98, 99 into handling string 94 for detection.

If all tests are positive, the tubing handling strings 94, 79, their respective handling nipples, and test tool 93 are removed from the hole by rotating the handling strings to the right. The orientation sleeve 70 and orientation bushing 74 are removed using the running tool 71. The tubing strings 90, 91 and annulus access nipple 92 are plugged. It will be noticed that throughout running setting of the tubing hanger and tubing strings complete pressure control is maintained at the surface by blowout prevention equipment connected to 10$\mu$ inches riser 53.

Figure 4:
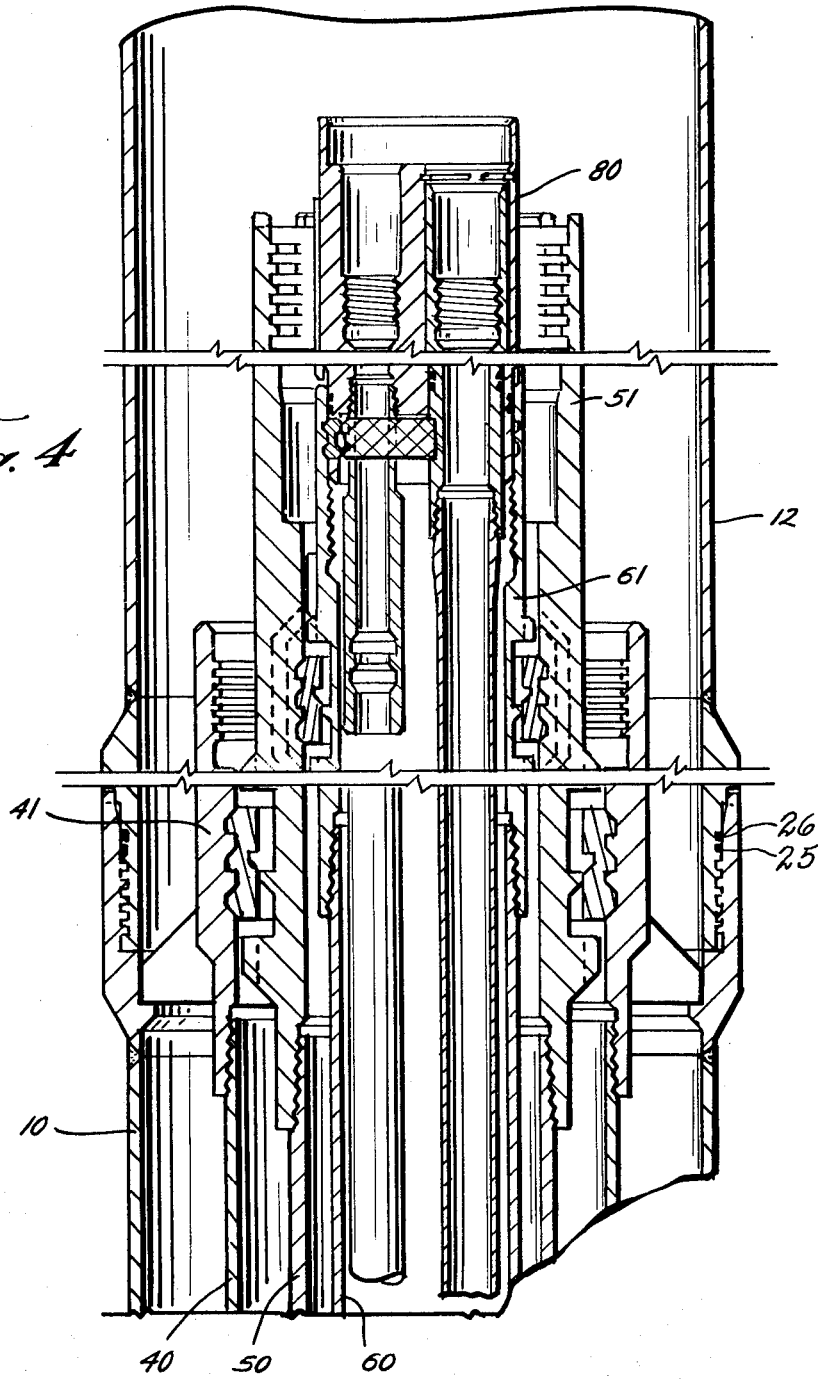

Next, the pressure control equipment, 10$\mu$ inches riser 53 and 16 inches riser 43 are removed by 30° rotation to the right for disengagement of breech block connections 54 and 46. At this stage, the wellhead will appear as shown in FIG. 4 with conductor extension 12 being the only remaining riser.

Figure 5:
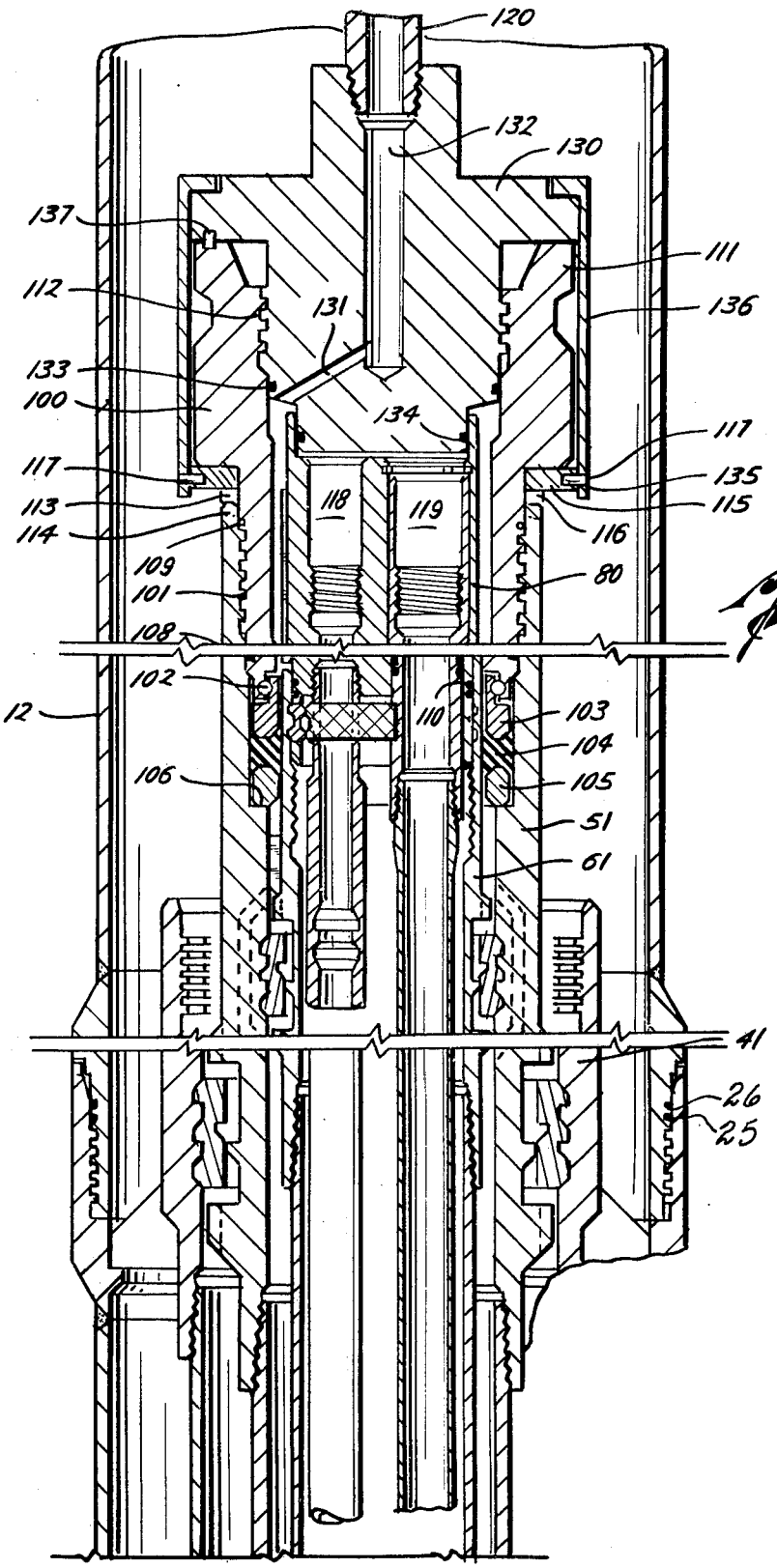

Referring now to FIG. 5, a tubular Christmas tree adapter 100 is run on drill pipe 120 using a combination running testing tool 130. The external midportion of adapter 100 is provided with the male part of a breech block connection 101 for engagement with the female part of the connection 101 in the 10$\mu$ inches head 51. Rotatably connected by ball bearings 102 to the lower part of adapter 100 is an annular packoff assembly comprising a resilient seal member 104 sandwiched between upper and lower retainer members 103, 105. Lower retainer 105 is stopped against hanger-head shoulder 106 and as the breech block connection 101 is engaged upper retainer ring 103 presses against seal member 104 causing it to sealingly engage the walls of hanger-heads 51 and 61. A pore 131 connects the bore 132 of tool 130 with the annular space between adapter 100 and tubing hanger 80. This space is sealed at 133, 134 by O-rings, allowing adapter seals 104, 108, 109 and tubing hanger seals 110 to be tested.

Christmas tree adapter 100 has an upper flange member 111 and internal connection threads 112 to which tool 130 is connected. Christmas tree adapter 100 also has stop lugs 113 which cooperate with stop lugs 114 on the top of hanger-head 51 when the breech-block connection is made to stop rotation at full engagement. To prevent disengagement, a locking ring 115 with depending lugs 116, is mounted around adapted 100 and held upwardly thereon as shown by radial pins 117 which ride in an "L" slot 135 in sleeve skirt 136 of tool 130. A shear pin 137 is sheared on further right hand rotation of tool 130. This allows skirt 136 to rotate to a position where pins 117 drop out of the L slot allowing the locking ring 115 to drop downwardly so that its lugs 116 fall between the back of adapter lugs 113 and the next closest hanger-head lug 114. This prevents rotation of adapter 100 in either direction thus locking it in position. Further rotation of tool 130, to the right, releases it for removal from the wall.

If it is decided to temporarily abandon the well, rather than immediately complete it, a corrosion cap (not shown) may be run on drill pipe using a J type running tool. It would be connected to the internal threads 112 of tubing head adapter 100. The corrosion cap could be provided with a port for spotting oil within the wellhead to prevent corrosion. This port would, of course, be plugged after the oil was injected. After installation of the corrosion cap, conductor riser 12 would be removed by rotating 30° to the right. A corrosion cap top could be installed by a diver and the well could be temporarily abandoned.

Alternatively, if it is desired to immediately complete the well, rather than install a corrosion cap, the Christmas tree would be installed. To do this, conductor riser 12 would be removed. Now referring also to FIG. 6, a small guide base 140 with two guide posts 141 would be clamped around the lower part of adapter 100 or hanger-head 51 by a diver. The guide base would be oriented by a tool with two pins adapted to engage tubing hanger receiving pockets 118, 119.

Figure 6:
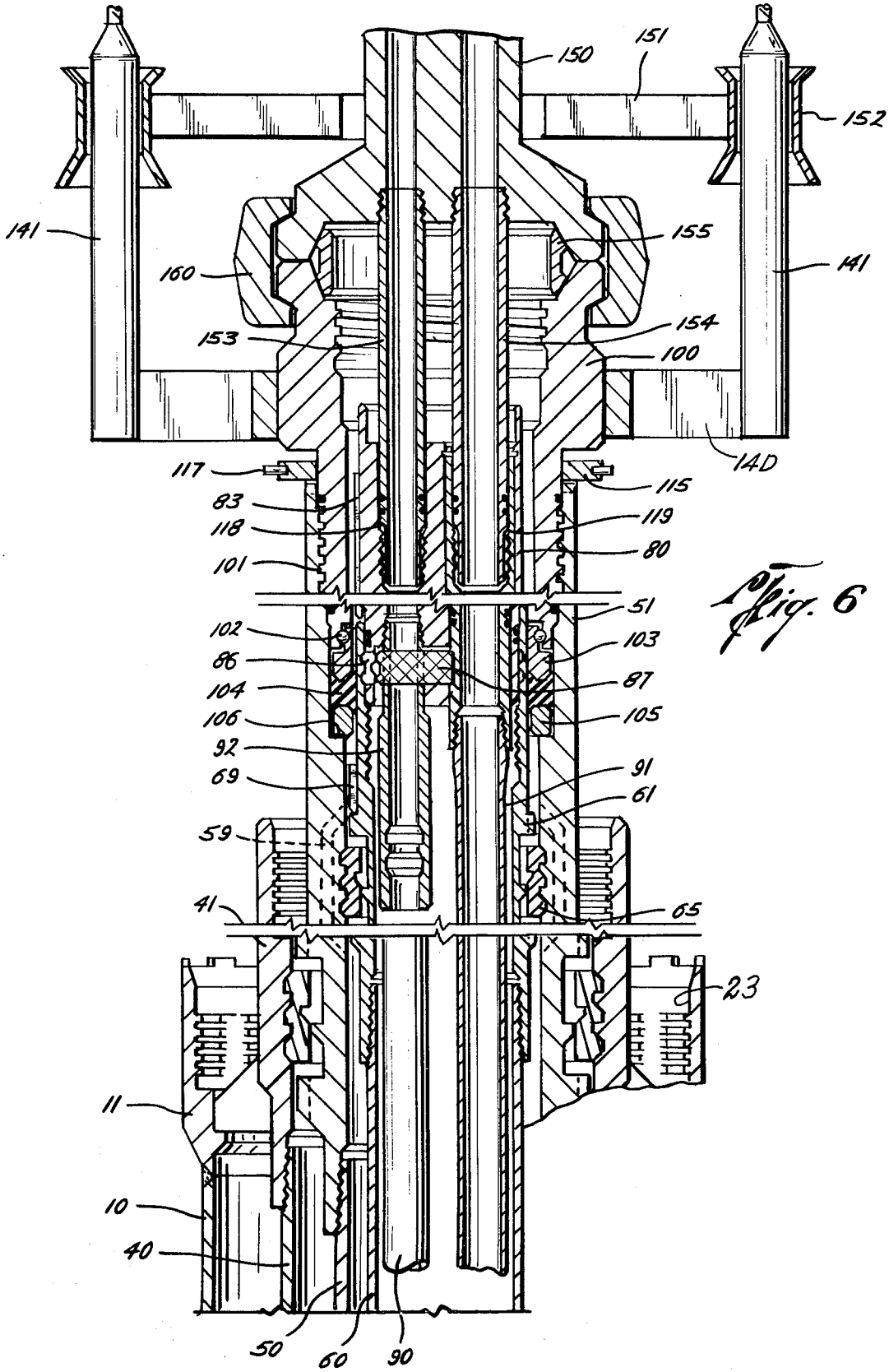

Next, Christmas tree 150 would be lowered to the wellhead. It would be provided with guide arms 151 and bell bottom sleeves 152 which would engage guide posts 141 to assist a diver in installing the tree 150. The base of tree 150 carries three, the one for tubing long nipples 153, 154 90 not shown, which sealingly engage the corresponding receiving sockets 118, 119, the one for tubing 90 not shown, in hanger 80. The base of tree 150 would come to rest against the upper face of adapter 100. An annular seal ring 155 would be provided at the joint. The tree 150 is then clamped to Christmas tree adapter 100 by a standard type clamp 160. A remote hydraulic connector could be used as an option eliminating the need for a diver to torque up clamp bolts. Thus, as shown in FIG. 6, the well is ready for production.

Should it be necessary at a future date to perform workover operations, tubing strings 90, 91 would be plugged and the Christmas tree 150 removed. Then a workover riser with a built in orientation sleeve and bushing similar to sleeve 70 and bushing 74 in FIGS. 2 and 3 would be attached to tree adapter 100. The orientation bushing would have a slot to engage key 83 of tubing hanger 80. In this manner, after the tubing hanger 80 is re-installed, following workover operations, it is landed in the same position as it was before workover operations.

If a tubingless sub-surface completion is desired, instead of a casing-tubing sub-surface completion, a somewhat different procedure is followed. However, with reference to FIG. 7, the first steps are the same as in the casing-tubing sub-surface completion just described. A 30 inches conductor casing 210, casing head 211, and conductor riser 212 connected by breech-block joint 214 are installed. A 16 inches casing 240, casing head 241, back-off joint 242, and riser 243 are installed. Next, the 10$\mu$ inches casing string 250, hanger-head 251, back-off joint 252, and riser 253 are installed as in the conventional completion.

There is a slight difference in hanger-head 251 and back-off joint 252. Hanger head 251 is provided with an internal vertical slot 259 immediately above the hanging recesses 258. Orientation in this method will be obtained by orienting the 10$\mu$ inches hanger-head 251 rather than the 7 inches hanger-head in the aforedescribed casing-tubing sub-surface completion. Back-off joint 252 is provided with an orientating bushing 260 which has a double ramp orienting slot 261 cut on a 45° angle. A vertical slot 262 is cut at the bottom of ramp 261 for alignment with hanger head slot 259. A hanger-head and back-off joint equipped with the modifications of hanger-head 251 and back-off joint 252 could be used with the casing-tubing sub-surface completion previously described, providing an option, at this point, of either casing-tubing completion or tubingless completion.

Blowout prevention equipment 2 is attached at the upper end of riser 253 at the drilling platform. Running of tubing will be performed through this blowout prevention equipment so that full pressure control is maintained at all times as in the previously described method.

In the next step, two strings of tubing 270, 271 are clamped together and run in the well tied by shear pins 273 to a tubing hanger assembly 280. Tubing hanger 280 is provided with outwardly biased hanging latches 281 and inwardly biased tubing latches 282 around openings 284, 285 through which tubing strings 270, 271 pass. An offset opening (not shown) through the hanger 280 provides access to the annulus between the tubing string 270, 271 and 10$\mu$ inches casing 250. This allows both cementing circulation and limited gas lift production.

Also provided on hanger 280 is an external spring loaded dog 290. Referring also to FIG. 7A dog 290 is beveled at the top 291 and bottom 292 so that it is cammed inwardly by any horizontal shoulder it encounters as the hangers is lowered into the well. However, looking at the face of dog 290, its bottom 292 is "V" shaped providing 45° angle edges 293, 294. If these angle edges 293, 294 encounter a matching 45° angle shoulder such as orienting ramp 261, the dog 290 will not be cammed inwardly but will ride down the ramp causing the tubing hanger 280 to rotate therewith. Thus, as the tubing strings 270, 271 and hanger 280 are lowered into the well, dog 290 engages ramp slot 261 rotating the hanger 280 until dog 290 falls through vertical slot 262 and into slot 259 as shown. Latches 281 engage hanging recesses 258 in a proper orientation.

Attached to the upper end of tubing strings 270, 271 are tubing hanging nipples 275, 276 which are provided with external hanging grooves 277, 278. One of the nipples, in this case 275, is longer than the other for reasons to be described subsequently. Running tools 286, 287 connect the hanging nipples 275, 276 to running strings 296, 297.

Figure 7:
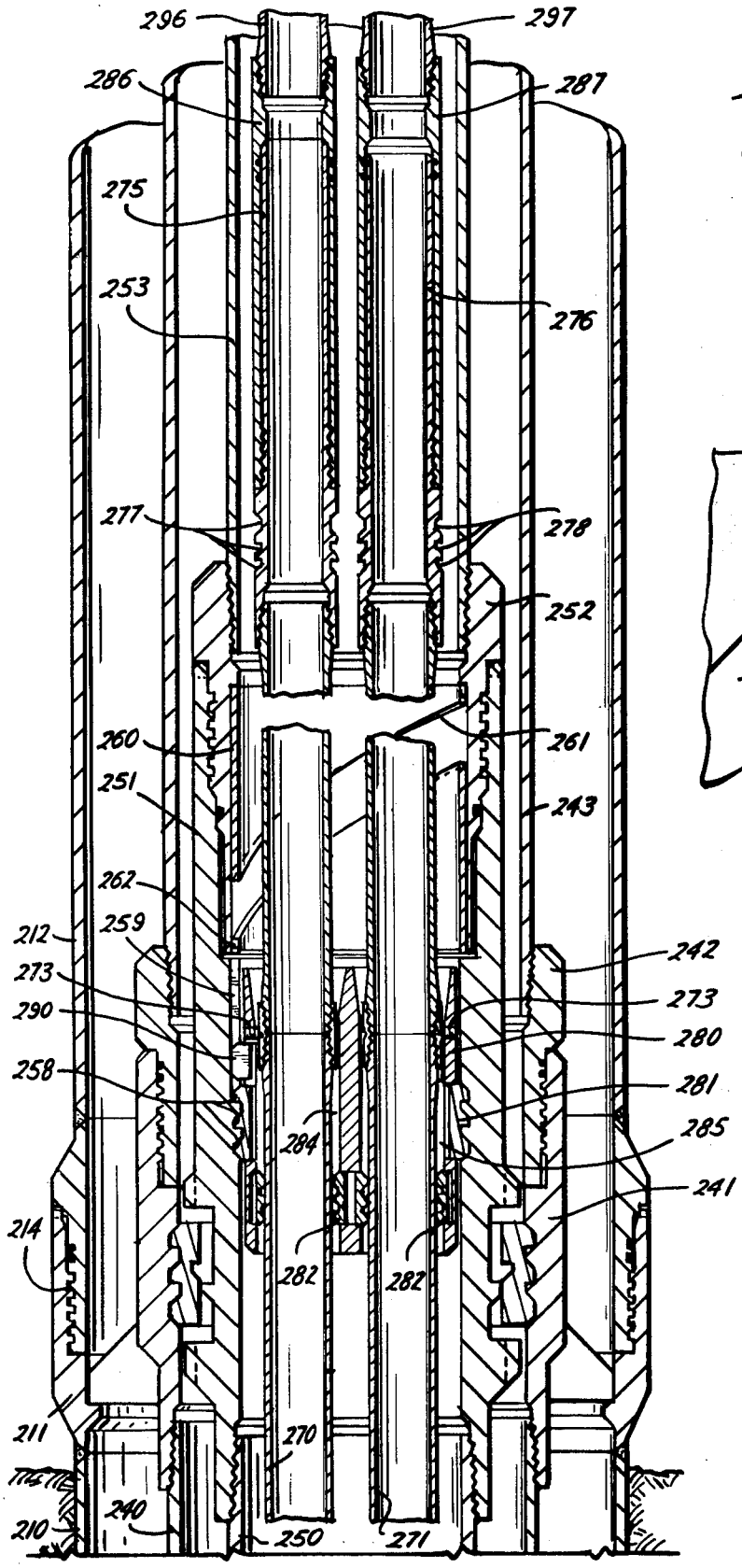
FIGS. 7 through 10 are step by step sectional elevation views of an underwater well showing a method and apparatus for tubingless completion of a well according to a preferred embodiment of the invention.
Figure 7A:
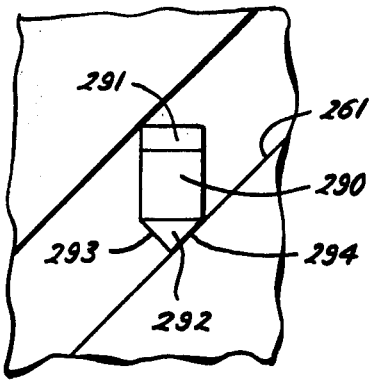
Figure 8:
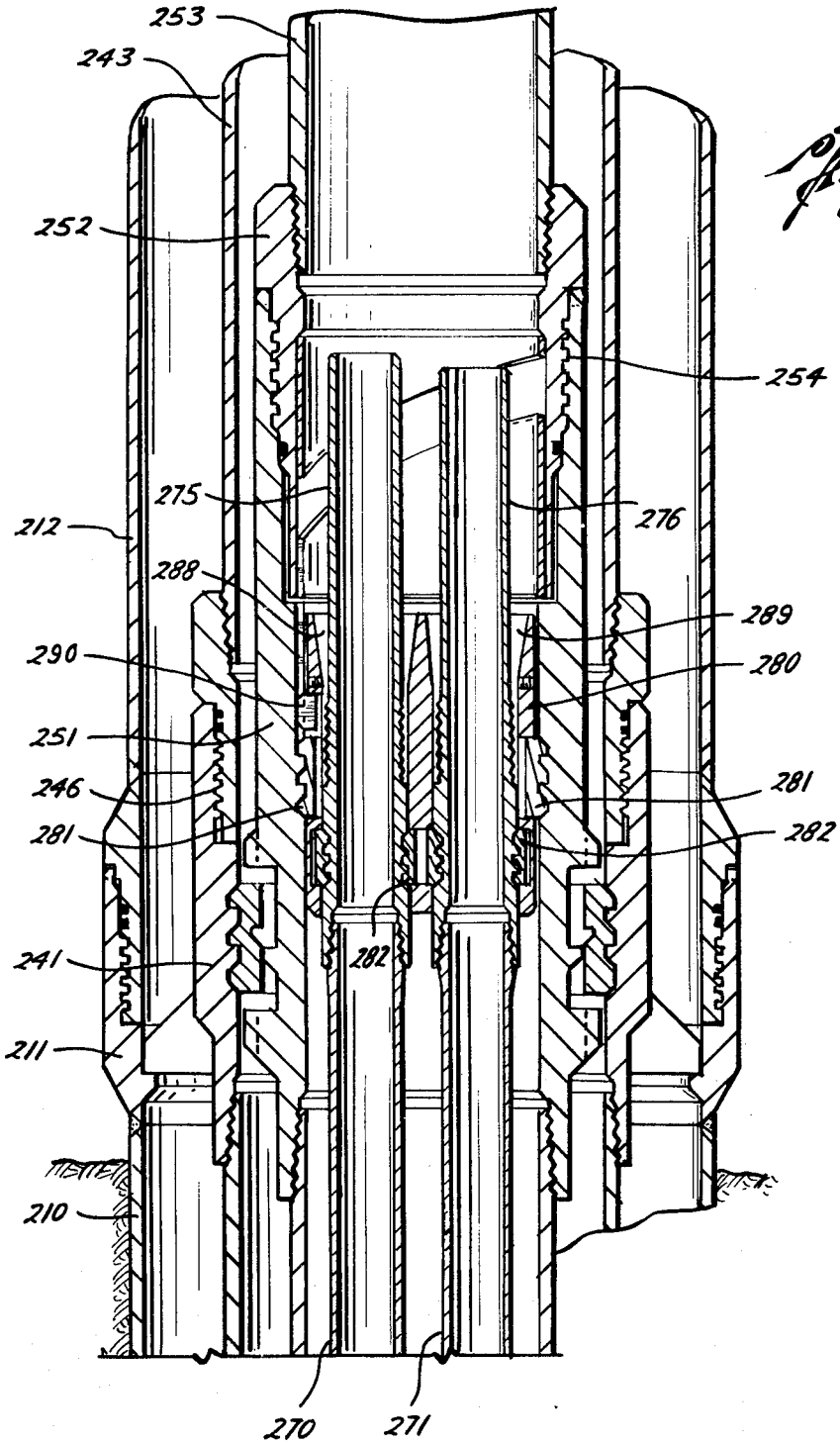

After the tubing hanger 280 is in place as shown in FIG. 7, the weight of tubing 270, 271 shears pins 273. Both strings 270, 271 are then run to bottom and tubing latches 282 engage the latch grooves 277, 278 in hanging nipples 275, 276, supporting the tubing strings as shown in FIG. 8. Both strings can then be cemented and handling strings 296, 297 and running tools 286, 287 removed by rotation to the right. At this stage of completion the wellhead equipment appears as in FIG. 8.

If for any reason tubing strings 270, 271 should become stuck after tubing hanger 280 is latched in, and cannot be freed, both strings would be cemented in. Then a standard outside tubing cutter would be run over one of the tubing strings. The cutter would be modified slightly to support tubing slips at its bottom. These tubing slips (not shown) would be lowered to engage tapered receiving bowls 288, 289 in the top of the hanger 280. The slips would be set and then the tubing string would be cut off at a distance from hanger 280 equal to the height of hanging nipples 275, 276, one longer than the other. After one tubing is set and cut the same procedure would be followed for the other tubing string.

Next, tubing strings 270, 271 are plugged and risers 253 and 243 are removed by thirty degree rotational disengagement of breech-block connections 246, 254 as in the casing-tubing sub-surface completion previously discussed. This leaves only the 30 inches riser 212.

Figure 9:
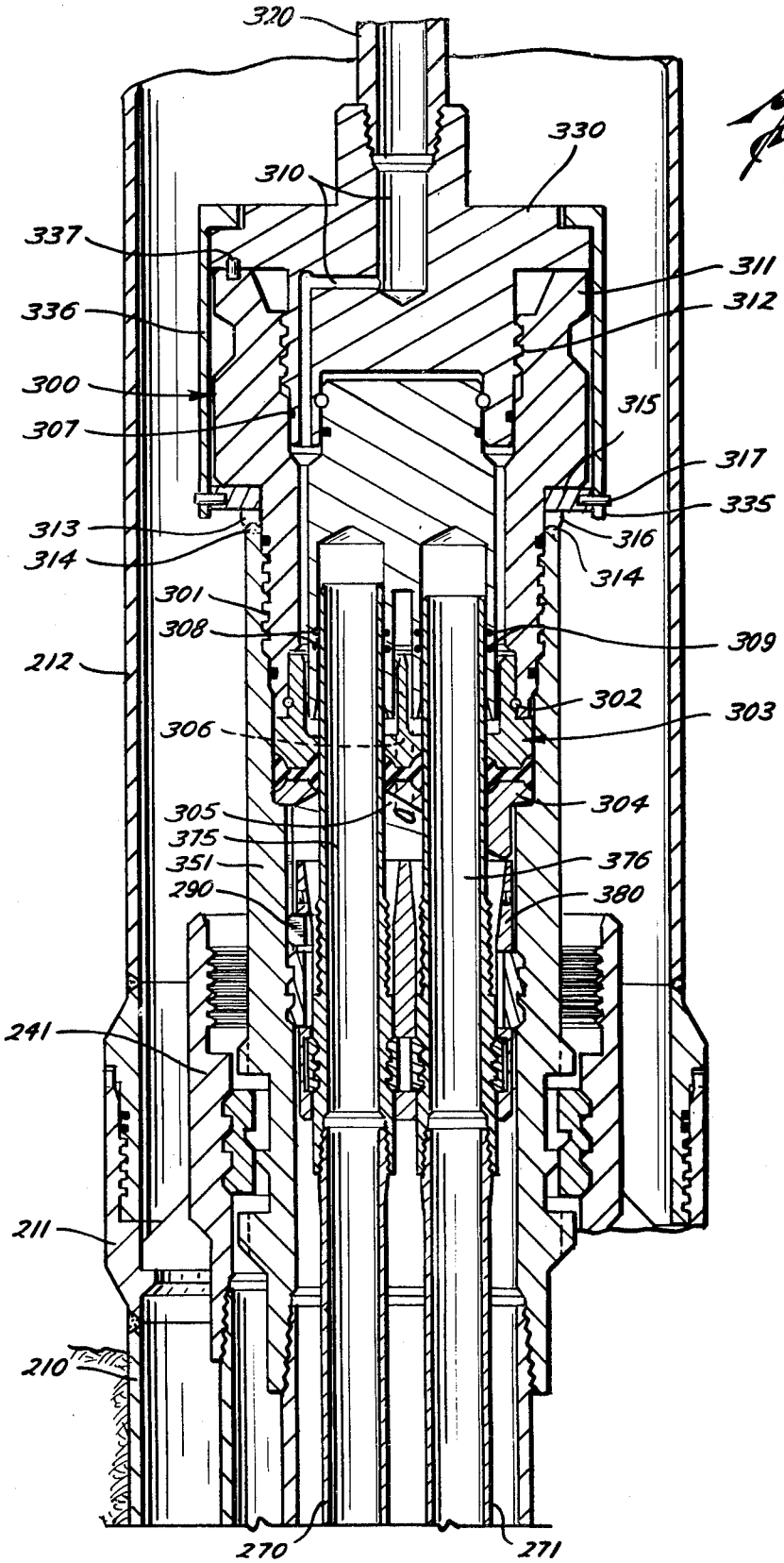

As now shown in FIG. 9, a Christmas tree adapter 300, similar to the adapter 100 (FIGS. 5 and 6), is lowered through riser 212 on drill pipe 320 and combination running and testing tool 330. The external mid-portion of adapter 300 is provided with the male part of breech-block connection 301 for engagement with head 251. Rotatably connected by ball bearings 302, at the lower part of adapter 300, is annular packoff assembly 303. Assembly 303 differs from the casing-tubing sub-surface completion apparatus in that it is designed to also packoff around hanging nipples 275, 276 as well as against head 251. The lower retaining ring 304 of packoff assembly 303 is provided with an offset frusto-conical surface, the axis of which coincides with the axis of landing nipple 275. Thus, if the packoff assembly is not properly oriented as tubing head adapter 300 is lowered into place, the frusto-conical surface 305 contacts one of the tubing nipples, and is cammed around to the proper orientation. Nipple 275 is longer than nipple 276 to prevent the possibility of both nipples contacting surface 305 at the same time should assembly 300 be exactly ninety degrees out of proper orientation. Packoff assembly 300 also has an annular access port 306.

Running tool 330 seals on the inside diameter of adapter 300 at 307 and on the outside diameter of hanging nipples 275, 276 at 308, 309. Internal porting 310 within the tool 330 permits pressure testing of the packoff assembly 303.

Christmas tree adapter 300 has an upper flange member 311 and internal connection threads 312 to which tool 330 is connected. The adapter 300 also has stop lugs 313 which cooperate with hanger-head stop lugs 314 to limit stop rotation at full engagement as explained with reference to FIG. 5 in the casing-tubing sub-surface completion method previously described herein. Also provided is a lock ring 315 held first in an upward position by sleeve skirt 336 of the tool 330. After shearing of pin 337 right hand rotation of tool 330 allows pins 317 to drop out of L slots 335 in sleeve 336 allowing its lugs 316 to drop between the back of adapter lugs 313 and the next closest hanger-head lugs 314, locking the adapter in its fully engaged position. Further rotation of tool 330 frees it for retrieval from the well.

The well can then be temporarily abandoned as explained in the casing-tubing sub-surface method previously described or it can be completed for production. If it is to be completed for production, at this point, conductor riser 212 is disconnected from conductor head 211 by 30° rotation and removed.

Figure 10:
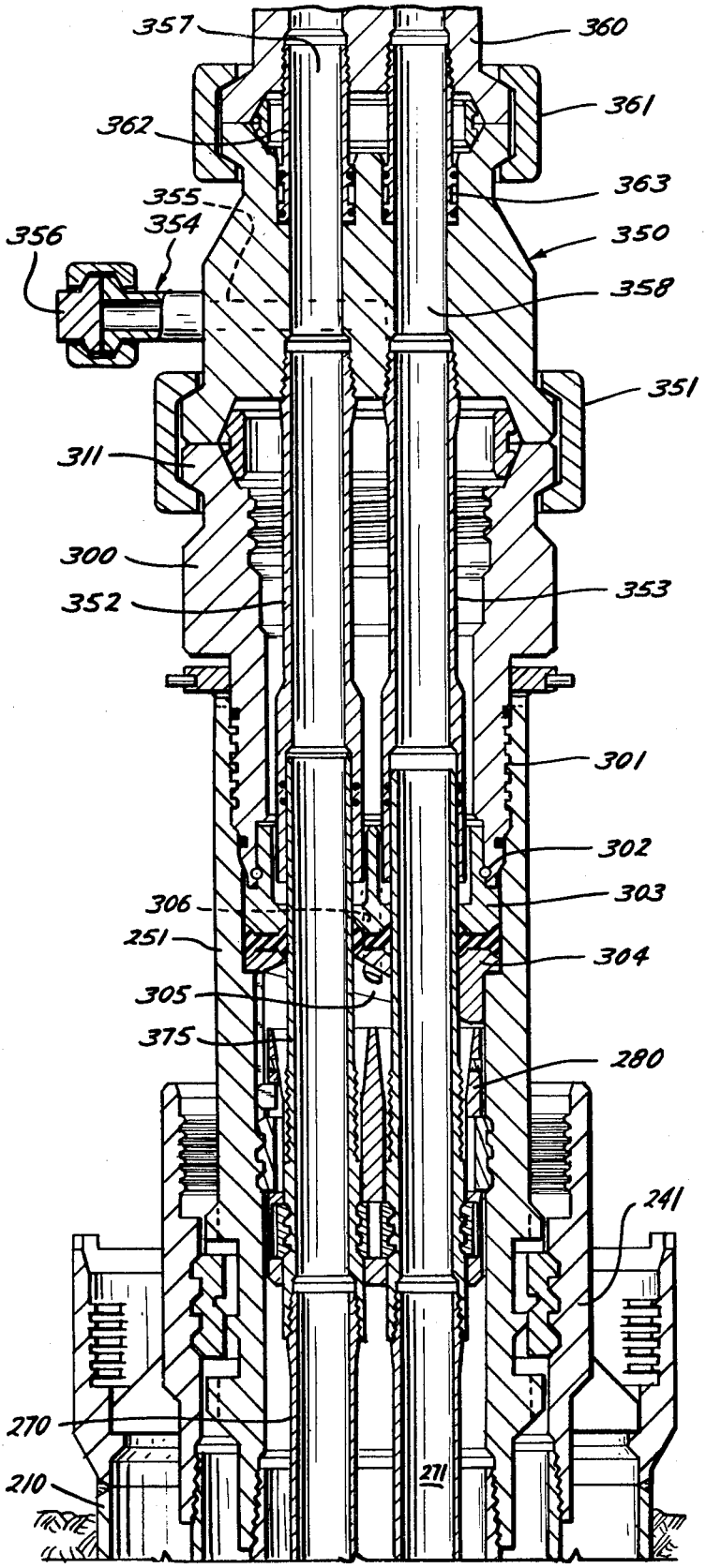

Now referring to FIG. 10, a spool piece 350, and Christmas tree 360 is guided into place and attached to adapter flange 311 by standard type diver assist clamp 351. Spool piece 350 may be lowered by itself first with Christmas tree 360 being lowered afterward. Alternatively, Christmas tree 360 may be assembled with spool piece 350 by clamp 361, then lowered together into place for attachment to adapter 300. Spool piece 350 is provided with nipples 352, 353 which stab and seal over hanging nipples 275, 276. It is also provided with a side opening outlet 354 and bore 355 communicating with port 306 and tubing-casing annulus below hanger 280 through a port (not shown) in hanger 280. A valve removal plug 356 allows for future installation of a side outlet valve. Christmas tree 360 is provided with short nipples 362, 363 which sealingly engage pockets provided for this purpose in spool piece 350. Nipples 362, 363, 352, 353, 275, 276 and spool bores 357, 358 provide unobstructed full opening into tubing strings 270, 271.

The foregoing methods and apparatus for completing an underwater well for both the casing-tubing sub-sea completion or tubingless completion offer definite advantages in both speed and safety. Complete pressure control at the drilling platform is maintained at all times and the apparatus used permits fast connection and disconnection for reduction of expensive rig time.

We claim:

1. A pipe joint for connecting first and second pipes of a pipe string passing through a body of water and driven into the sea floor comprising:

a first tubular member affixed to the first pipe;

a second tubular member affixed to the second pipe, said first tubular member having a portion thereof insertable within said second tubular member;

a plurality of circumferentially spaced groupings of teeth disposed on both of said members;

the pipes being connectable upon a rotation of one of the pipes in a common plane, said common plane being perpendicular to the axis of rotation;

stop means on one of said members engageable with means on the other member to limit said rotation to less than one revolution;

said teeth disposed on one of said members having surfaces engageable, when an axial tension load is placed on the pipe joint, with cooperable surfaces on teeth disposed on the other of said members; said cooperable surfaces being in planes perpendicular to said axis of rotation, thereby avoiding any substantial radial load on the pipe joint upon the application of axial tension loads; and abutting support means on said tubular members to transmit axial compression loads applied to the pipe joint whereby the pipe joint is capable of sustaining axial tension loads, axial compression loads, and bending moments caused by the driving of the pipe string into the sea floor and by the water currents.

2. A pipe joint as defined in claim 1 wherein said stop means includes an engagement member for each grouping of teeth disposed on one of said tubular members and at least one stop member on the other of said tubular members for engagement with one of said engagement members upon a rotation of less than 30°; said pipe joint further including a movable lock element adjacent said stop member to prevent rotation in the opposite direction upon the engagement of said stop member and said one of said engagement members.

3. A pipe joint as defined in claim 1 further including dual seal means disposed on one of said tubular members for sealing engagement with the other tubular member for establishing fluid tight communication between said first and second tubular members; said dual seal means trailing said teeth on said one of said tubular members to prevent engagement of said dual seal means with said teeth on said other tubular member.

4. A pipe joint according to claim 1 wherein said support means is so positioned on said tubular members that said support means transmits all of said axial compression loads at said pipe joint.

5. A pipe joint according to claim 1 wherein said support means includes an annular shoulder on said second tubular member engaging a correlating annular shoulder on said first tubular member; said shoulders and said pipes having an equal radial extent from the axis of rotation whereby the path of the driving force of said axial loads is co-axial through said joint and pipes.

6. A pipe joint according to claim 1 wherein said teeth have no-lead.

7. A pipe joint according to claim 1 wherein said teeth are square in cross-section.

8. A pipe joint according to claim 1 wherein said groupings of teeth are circumferentially spaced apart at least every 30° on said members to provide engageable surfaces upon the application of a bending moment on one of said members towards one of said groupings.

9. A pipe connection for forming between one and another pipe ends a fluid tight fluid conveying joint freely made up and broken apart by nearly torqueless relative rotation of said pipe ends coupled with nearly forceless axial approach and separation of said pipe ends and especially adapted for use in connecting underwater pipes of large diameter such as well heads and casing passing through a body of water and driven into the sea floor, said connection including a pin formed by one pipe end and a socket formed by the other pipe end, said pin and socket each carrying disposed about its periphery, the outer periphery in the case of the pin and the inner periphery in the case of the socket, a plurality of circumferentially spaced-apart groups of axially spaced-apart no-lead threads having zero pitch on their juxtaposable surfaces, having reference to the pin thread surfaces facing away from the pin terminus and the socket thread surfaces facing away from the socket terminus, same being the surfaces which will prevent axial separation of the pin and socket when engaged as hereinafter specified, the circumferential spacing of said socket thread groups being greater than the circumferential extent of the pin thread groups and the circumferential spacing of the pin thread groups being greater than the circumferential extent of the socket thread groups, whereby said pin can be inserted axially into said socket, said pin and socket having engageable annular shoulders thereabout limiting inserting of the pin in the socket, said pin threads being spaced axially from said pin shoulder a distance equal to the axial spacing from the socket shoulder of the spaces between the socket threads to provide for free substantially torqueless interengagement of said threads upon relative rotation of the pin and socket after the pin is inserted and said shoulders are engaged, and for substantially torque free disengagement of said connections by reverse relative rotation of said pin and socket, such rotation being opposed primarily only by friction between the shoulders and depending on the axial loading but being substantially unopposed by the pitch free threads, said pin and socket each including unthreaded areas of untapered cylindrical configuration, said area of the pin making a free fit within the like area of the socket whereby said pin and socket can be readily separated when desired, and elastomeric seal means carried by one of pipe ends in one of said unthreaded areas for forming a fluid tight seal between said pipe ends whereby fluid can be conducted by said joint without leakage despite rocking of said pipe ends one relative to the other, said threads having a square profile for avoiding any substantial radial load on either tubular member upon the application of either axial tension loads or axial compression loads on the pipes whereby the pipe connection is capable of sustaining axial tension loads, axial compression loads, and bending moments caused by the driving of the pipe into the sea floor and by the water currents.

* * * * *

UNITED STATES PATENT AND TRADEMARK OFFICE

CERTIFICATE OF CORRECTION

PATENT NO. : 3,971,576

DATED : July 27, 1976

INVENTOR(S) : DAVID P. HERD and JOHN H. FOWLER

It is certified that error appears in the above-identified patent and that said Letters Patent are hereby corrected as shown below:

In the Abstract, line 23: After "A", insert -- Christmas tree --.

Column 1, line 43: After "conductor", insert -- casing --.

Column 2, line 14: After "connected", delete "attching" and insert -- attaching --.

Column 2, line 16: After "other", delete "riser" and insert -- risers --.

Column 4, line 7: After "30", delete "inches" and insert -- inch --.

Column 4, line 8: After "16", delete "inches" and insert -- inch --.

Column 4, line 20: After "10 3/4", delete "inches" and insert -- inch --.

Column 4, line 58: After "slot", delete "arrangemet" and insert -- arrangement --.

UNITED STATES PATENT AND TRADEMARK OFFICE

CERTIFICATE OF CORRECTION

PATENT NO. : 3,971,576

DATED : July 27, 1976

INVENTOR(S) : DAVID P. HERD and JOHN H. FOWLER

It is certified that error appears in the above-identified patent and that said Letters Patent are hereby corrected as shown below:

Column 5, line 17: After "75", delete "unitil" and insert -- until --.

Column 5, lines 67 and 68: After "to", delete "10 inches" and insert -- 10 3/4 inch --.

Column 6, line 1: After "equipment", delete "10 inches" and insert -- 10 3/4 inch --.

Column 6, line 2: After "16" delete "inches" and insert -- inch --.

Column 6, line 12: After the second instance of "the", delete "10 inches" and insert -- 10 3/4 inch --.

Column 6, line 21: After "A", delete "pore" and insert -- port --.

Column 6, line 33: After "around", delete "adapted" and insert -- adapter --.

UNITED STATES PATENT AND TRADEMARK OFFICE

CERTIFICATE OF CORRECTION

PATENT NO. : 3,971,576

DATED : July 27, 1976

INVENTOR(S) : DAVID P. HERD and JOHN H. FOWLER

It is certified that error appears in the above-identified patent and that said Letters Patent are hereby corrected as shown below:

Column 6, line 44: After "the", delete "wall" and insert -- well --.

Column 7, line 2: After "three", delete ", the one for tubing".

Column 7, line 3: After "154", insert -- , the one for tubing --.

Column 7, line 30: After "30", delete "inches" and insert -- inch --.

Column 7, line 32: After "16", delete "inches" and insert -- inch surface --.

Column 7, line 34: After "the", delete "10 μ inches" and insert -- 10 3/4 inch --.

Column 7, line 41: After "the", delete "10 μ inches" and insert -- 10 3/4 inch --.

UNITED STATES PATENT AND TRADEMARK OFFICE

CERTIFICATE OF CORRECTION

PATENT NO. : 3,971,576

DATED : July 27, 1976

INVENTOR(S) : DAVID P. HERD and JOHN H. FOWLER

It is certified that error appears in the above-identified patent and that said Letters Patent are hereby corrected as shown below:

Column 7, line 42: After "7", delete "inches" and insert -- inch --.

Column 7, line 68: After "and", delete "10 μ inches" and insert -- 10 3/4 inch --.

Column 8, line 7: After the first occurrence of "the", delete "hangers" and insert -- hanger --.

Column 8, line 55: After "30", delete "inches" and insert -- inch --.

Signed and Sealed this

First Day of February 1977

[SEAL]

*Attest:*

RUTH C. MASON
*Attesting Officer*

C. MARSHALL DANN
*Commissioner of Patents and Trademarks*